US005382226A

United States Patent [19]

Graham

[11] Patent Number: 5,382,226

[45] Date of Patent: Jan. 17, 1995

[54] INFLATABLE CERVICAL TRACTION AND EXERCISING DEVICE

[76] Inventor: Richard A. Graham, 18582 Main St., Huntington Beach, Calif. 92648

[21] Appl. No.: 17,042

[22] Filed: Feb. 12, 1993

[51] Int. Cl.[6] ..... A61H 1/02

[52] U.S. Cl. ..... 602/32; 602/18; 602/38; 128/845; 601/23; 606/237

[58] Field of Search ..... 128/845, 869, 870, 871, 128/876, DIG. 20, DIG. 23; 602/13, 17, 18, 19, 32, 33, 34, 35, 38, 60, 61, 74; 606/237, 240, 241; 601/23

[56] References Cited

U.S. PATENT DOCUMENTS

| | | | |
|---|---|---|---|
| 2,806,471 | 9/1957 | Breese . | |
| 3,521,623 | 7/1970 | Nichols et al. . | |
| 3,667,457 | 6/1972 | Zumaglini | 602/19 |
| 3,974,827 | 8/1976 | Bodeen | 606/237 |
| 4,024,861 | 5/1977 | Vincent | 602/19 |
| 4,161,946 | 7/1979 | Zuesse . | |
| 4,194,501 | 3/1980 | Watt . | |
| 4,583,532 | 4/1986 | Jones . | |
| 4,669,455 | 6/1987 | Bellati | 602/13 |
| 4,736,736 | 4/1988 | Moers . | |
| 4,805,603 | 2/1989 | Cumberland . | |
| 5,003,968 | 4/1991 | Mars . | |
| 5,062,414 | 11/1991 | Grim . | |
| 5,070,865 | 12/1991 | Iams . | |
| 5,147,287 | 9/1992 | Jewell | 602/33 |
| 5,154,186 | 10/1992 | Laurin | 128/870 |
| 5,207,716 | 5/1993 | McReynolds | 128/870 |
| 5,305,750 | 4/1994 | Makita | 128/845 |

*Primary Examiner*—Robert A. Hafer
*Assistant Examiner*—David J. Kenealy
*Attorney, Agent, or Firm*—Lyon & Lyon

[57] ABSTRACT

A cervical traction and exercise device adapted to be secured about the head and neck for imparting the desired lordotic shape into the cervical region of the spine and manipulating the spine and surrounding tissue to promote fluid and cellular exchange in and around the intervertebral discs. The device includes a frame, an upstanding neck support carried by the frame, an inflatable elongated bladder carried by the neck support, restraining straps for securing the device to the user's head such that the bladder is disposed below and adjacent the user's neck, and means for selectively inflating and deflating the bladder to force the cervical spine to curve forwardly and apply angular traction to the spine.

5 Claims, 3 Drawing Sheets

INFLATABLE CERVICAL TRACTION AND EXERCISING DEVICE

BACKGROUND OF THE INVENTION

The present inventions relates to a cervical traction and exercising device. The cervical region of the spine normally defines a forward curve of about 45 degrees whereby weight is distributed relatively evenly on the individual articular surfaces and discs. Research has shown that without such a forward curve in the cervical region of the spine, the weight of the head bears forwardly on the soft non-bony intervertebral discs causing the discs to wear and degenerate. Additionally, individuals with diminished, lost or reversed cervical spinal curves exhibit a significant loss of the natural joint movement, limiting the normal canaliculus seepage and imbibition of adjacent fluids via vertebral end plates and annuli. Without such nutrient rich fluids, the discs tend to dehydrate, further weakening the discs and resulting in a further loss of mobility, degeneration and possibly nerve damage. Active nutrient transport is particularly important because the intervertebral discs' indigenous vascular supply disappears at approximately 20 years of age.

Spinal traction devices have heretofore been developed for the purpose of restoring the normal lordotic curve in the cervical area of the spine to prevent disc degeneration. Such devices have typically comprised a flat U-shaped support frame having a Vee-shaped neck support projecting outwardly from the lower portion of the frame. One or more straps were secured to the frame which extended about the wearer's forehead and/or under jaw to secure the traction device to the user's head. Upon positioning the neck support under a stress point in the cervical area of the spine and tightening the straps about the user's forehead and/or jaw, the head is pulled rearwardly about the neck support as the neck support bears against the neck, forcing the cervical area of the spine into a lordotic shape. Repeated periodic use of such devices has proved successful in many cases in restoring a forward curvature to the cervical spine. However, the inability of the user to regulate the force exerted on the spine by the device and the reliance on static traction alone in reshaping the cervical spine has significantly limited the therapeutic potential of such devices.

The force exerted on the cervical spine by the types of prior art devices described above is exerted in a single outward direction normal to the plane of the supporting frame. The amount of force exerted on the spine is determined by the shape and size of the user's neck, the extent to which the neck support projects above the horizontal surface on which the user and traction device are disposed, and the rearward force exerted on the head by the restraining straps. As the shape and size of the user's neck and the outward extension of the neck support are fixed, the only adjustments which can be made in the force exerted on the cervical spine with such devices is in the tightening of the restraining straps. Those straps, however, cannot be readily tightened without first being loosened and relieving the pressure on the spine, nor are they well adapted for providing a controlled traction against the spine. As a result, the force exerted on the spine is neither continuously nor incrementally variable with any degree of precision. Thus, a user could not gradually increase the magnitude of the spinal arc to his or her level of tolerance with such devices without having to intermittently relieve the pressure on the spine. If the user were capable of such control, the efficiency of the device in imparting curvature into the spine would be greatly enhanced. In addition, these devices while arching the spine do not adequately work the spine and surrounding tissue which, if done, would actively promote fluid imbibition in the discs and thereby further enhance the rehabilitation process. The cervical traction and exercising device of the present invention overcomes these shortcomings in the prior art.

SUMMARY OF THE INVENTION

Briefly, the present invention relates to a traction and exercising device for imparting the desired lordotic shape into the cervical region of the spine and working the spine and surrounding tissue to promote fluid and cellular exchange in and around the intervertebral discs. The device includes a frame, a substantially ellipsoidal inflatable bladder transversely in a neck support cradle carried by the frame, and a pair of restraining straps for securing the device to the user's head such that the bladder is disposed against the back of the neck under a stress point in the cervical spine. Controlled inflation of the bladder by the user by means of a hand-held pump causes a controlled lifting and a stretching of the cervical spine. As the bladder is inflated, the configuration of the bladder causes the bladder to expand vertically and, to a lesser extent, transversely. The vertical expansion lifts the spine, creating a spinal apex while the transverse expansion of the bladder applies an angular traction to the neck on both sides of the apex. By controlling the inflation of the bladder, the user can control the lifting and stretching of the spine and incrementally increase the magnitude of spinal arc to his or her own tolerance. As the bladder is repetitively inflated to the tolerance of the user and deflated, the cervical spine is alternatively and actively forced from a lesser arc to a greater or hyperlordotic arc, thereby promoting nutrient transport to the intervertebral disc while simultaneously increasing the lordotic arc.

It is the principal object of the present invention to provide a cervical traction and exercising device for preventing degeneration of the cervical spine.

It is another object of the present invention to provide a device for restoring a normal lordotic shape to the cervical region of the spine.

It is another object of the present invention to provide a device for exercising the discs and vertebrae in the cervical region of the spine to promote normal fluid transport to the intervertebral discs.

It is a further object of the present invention to provide a device for restoring the normal lordotic curve to the cervical region of the spine which allows the user to readily regulate the lifting and stretching motion of the device to his or her own tolerance.

It is a still further object of the present invention to provide a user controlled cervical traction device for concurrently forcing the cervical spine forwardly and stretching the spine angularly to restore the spine to its normal lordotic shape and/or exercise the spine to promote fluid transfer in and around intervertebral discs.

These and other objects and advantages of the present invention will become readily apparent from the following detailed description taken in conjunction with the accompanying drawings.

DESCRIPTION OF THE PREFERRED EMBODIMENTS

In the Drawings

Figure 1:
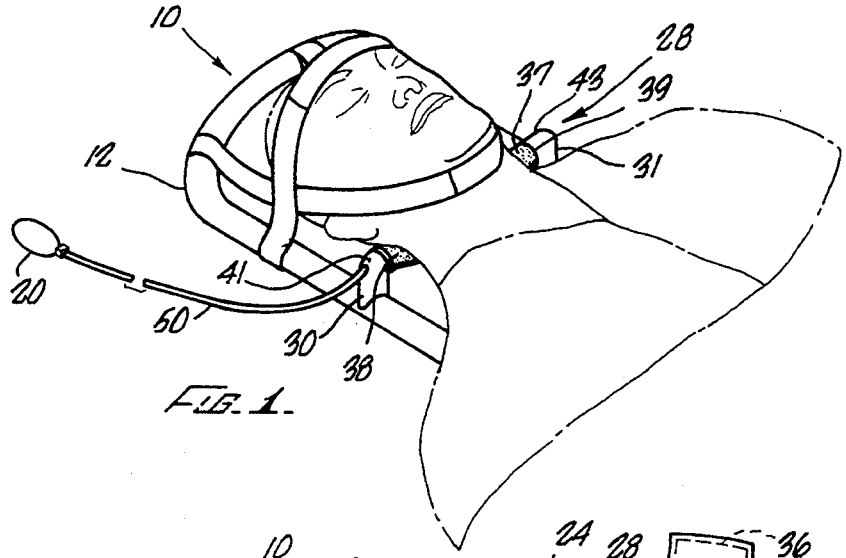
FIG. 1 is a perspective view of the traction and exercising device of the present invention.
Figure 2:
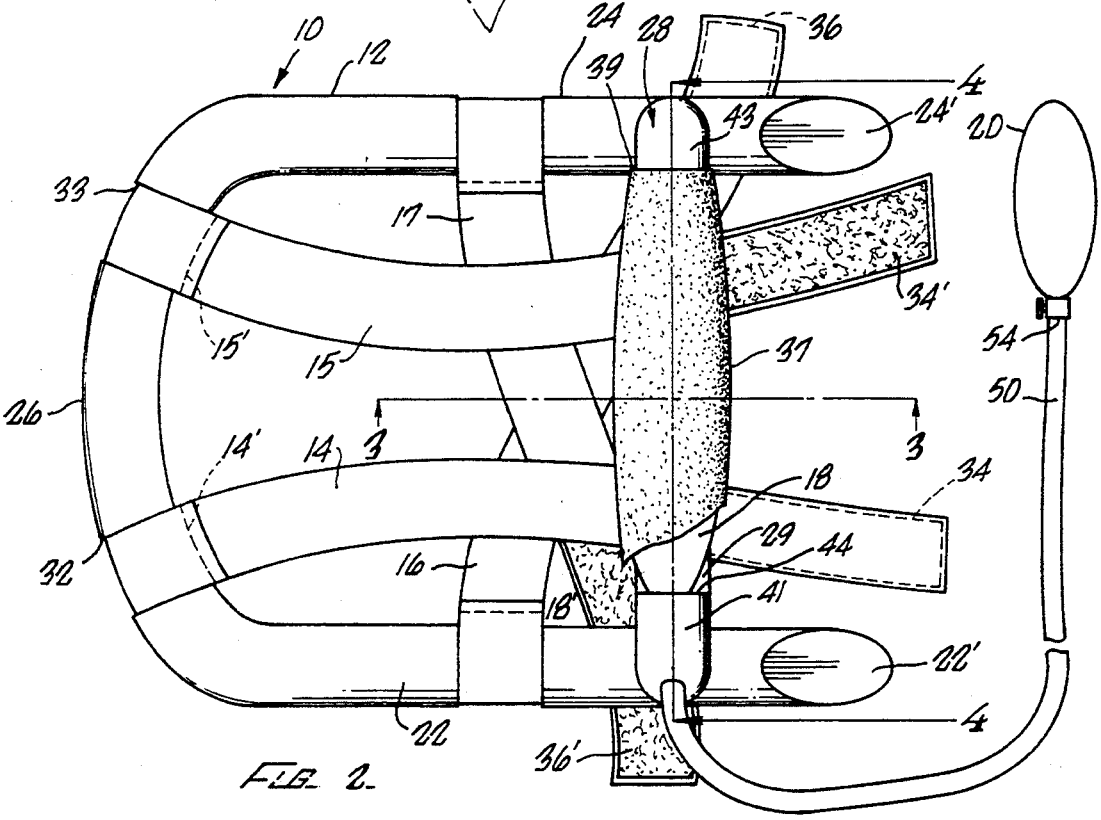
FIG. 2 is a plan of the device of the present invention.

FIGS. 8(*a*) and 8(*b*) are schematic representations illustrating the operation of the device on the cervical spine.

Referring now in detail to the drawings, the cervical traction and exercise device 10 of the present invention comprises a frame 12, a pair of chin restraint straps 14 and 15, a pair of forehead restraint straps 16 and 17, an inflatable air bladder 18 and an air pump assembly 20. The frame 12 is preferably molded of a durable plastic material in a tubular configuration so as to define a pair of side members 22 and 24, an arcuate spanning member 26 and a transverse neck support 28. The frame side members 22 and 24 are preferably slightly bowed and terminate in tapered ends 22' and 24'. The neck support 28 includes vertically extending portions 30 and 31 which project outwardly from the side members 22 and 24 respectively and project inwardly at 30' and 31' to define inwardly directed raised lateral portions 41 and 43. A neck cradle 29 extends transversely between portions 41 and 43, spanning frame side members 22 and 24.

The chin restraint straps 14 and 15 are each secured at one end thereof to opposed inclined lateral portions 32 and 33 of spanning member 26 so as to angularly extend therefrom such that the straps can be readily passed in an arcuate path under the user's chin and be secured together by interlocking hook and loop fasteners 34 and 34' disposed adjacent the extended ends of the straps. To secure the restraining straps 14 and 15 to the inclined portions 32 and 33 of the frame, portions 32 and 33 are preferably formed of a reduced diameter such that the ends of the straps can be looped thereover and sown against themselves at 14' and 15'. The forehead restraining straps 16 and 17 are each similarly secured at one end thereof to the frame side members 22 and 24 respectively and are spaced from the transverse neck support 28 such that straps 16 and 17 can be readily passed in an arcuate path over the user's forehead and secured together by interlocking hook and loop fasteners 36 and 36' disposed adjacent the extended ends of the straps. By such a strap configuration, the cervical traction and exercise device 10 can be easily and securely affixed to the user's head such that with the user lying flat on his or her back on a horizontal surface, the frame 12 rests on the surface and the neck support 28 is disposed under the user's neck and the tapered ends 22' and 24' of the frame side members are substantially adjacent the user's shoulders. The tightness of the securement of the device 10 to the user's head can be readily adjusted as needed by means of the hook and loop fasteners on the securement straps 14–17.

Figure 4:
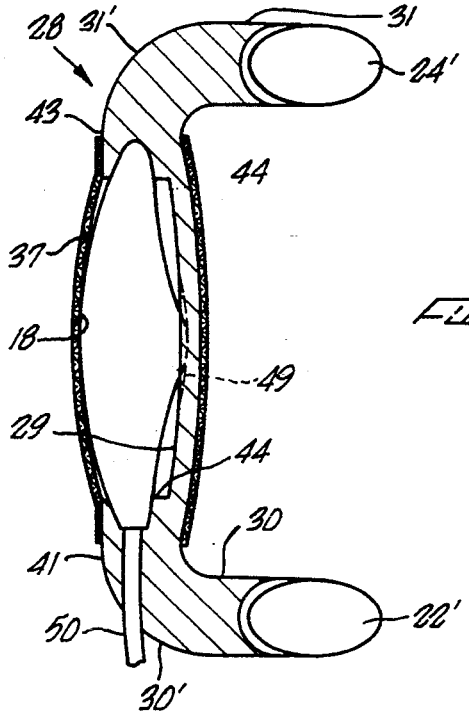
FIG. 4 is a section view taken along the line 4—4 in FIG. 1.

As seen in FIGS. 1 and 4, the expandable bladder 18 is carried by the neck support 28 in the cradle 29 defined therein and is preferably secured in place by an open ended elastic sleeve 37 which is disposed about the bladder 18 and cradle 29. Sleeve 37 is held in place by an elastic fitment of the open ends 38 and 39 of the sleeve disposed about the raised lateral portions 41 and 43 of neck support 28. The lateral portions 41 and 43 of neck support 28 are preferably provided with oppositely facing recesses 44 formed therein adjacent the lateral ends of cradle 29 for receiving the extended ends 18' of bladder 18 to facilitate retention and alignment of the bladder on the cradle 29.

Figure 3:
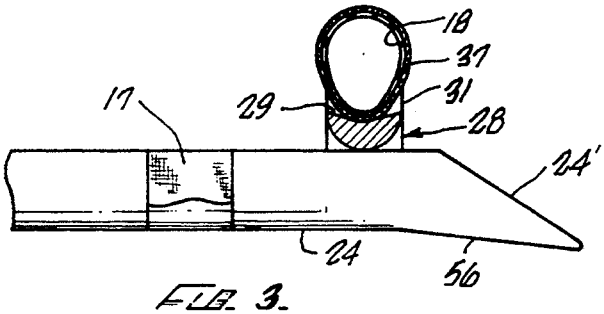
FIG. 3 is a section view taken along the line 3—3 in FIG. 1.
Figure 5:
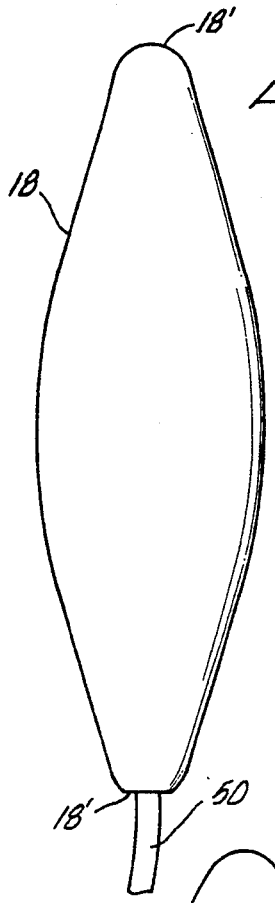
FIG. 5 is a top plan view of the bladder employed in the present invention illustrated in a fully inflated position.
Figure 6:
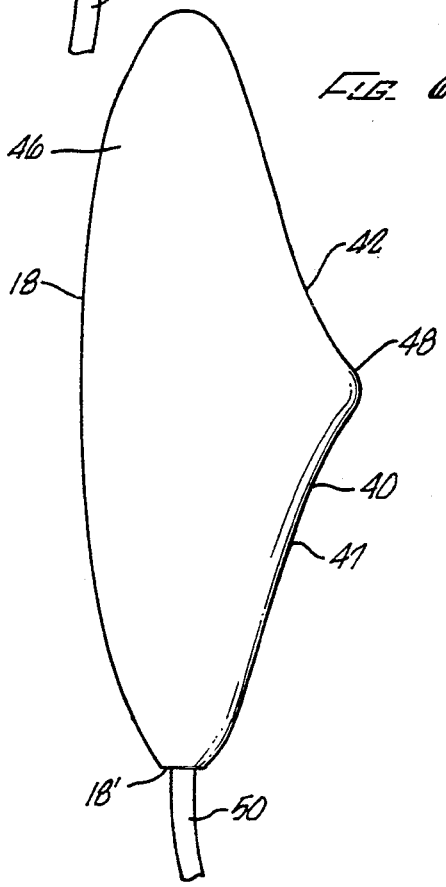
FIG. 6 is a side view of the bladder employed in the present invention, illustrated in a fully inflated state.

As seen in FIGS. 5 and 6, the upper portion 46 of bladder 18 is of a generally semi-ellipsoidal configuration having relatively pointed ends 18' similar to the upper half of a football bladder. In the preferred bladder configuration, the underside 47 of bladder 18 is formed with undercut portions at 40 and 42 so as to define a central depending portion 48 as seen in FIG. 3. A shallow trough 49 is preferably formed in cradle 29 to receive the underside of bladder 18. As a result of this bladder configuration, bladder 18, when inflated, will expand upwardly from the cradle 29 to a slightly greater extent than in a transverse direction. Additionally, it has been found that the provision of the depending portion 44 on the underside of the bladder provides a cushioning effect under the apex of the expanded bladder which bears against the user's neck, making the device more comfortable for the user. Thus, as the bladder is inflated under and against the user's neck, it expands vertically and transversely, lifting the spine to create a spinal apex and applying an angular traction to the neck on both sides of the spinal apex. The amount of traction exerted in the vertical direction, however, will be somewhat greater than that exerted longitudinally to obtain the vertical lift necessary to restore the normal lordotic share to the cervical region of the spine without overly tractioning the neck longitudinally.

Figure 7:
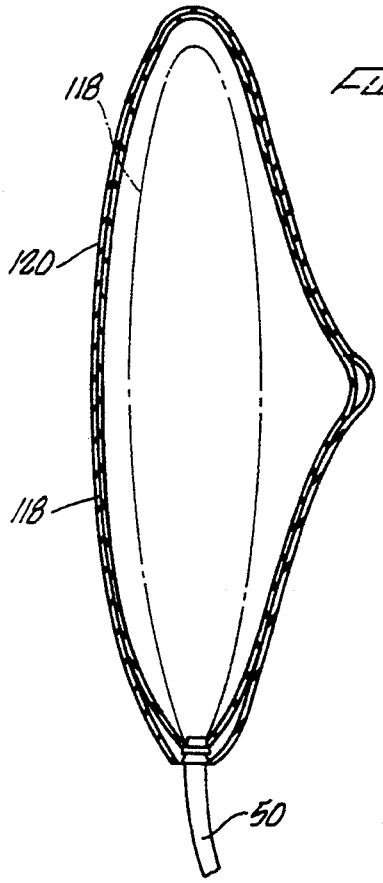
FIG. 7 is a sectional side view illustrating an alternate embodiment of the bladder.

In an alternate embodiment of the invention, illustrated in FIG. 7, the expandable bladder 118 is of a tubular configuration (illustrated in phantom lines) and is disposed in a non-expandable casing 120, preferably constructed of a vinyl material. Casing 120 is preferably formed in the above described generally ellipsoidal configuration of bladder 18. As the tubular bladder expands upon inflation, the expansion is limited by the configuration of the casing 120 to provide the desired increase in the vertical direction relative to the transverse direction as seen in FIG. 7. While the above described bladder configurations are preferred, it is to be understood that other configurations of expandable bladders could be employed in the present invention, either with or without an expansion controlling casing to provide the desired lifting and traction of the user's neck.

To provide selective inflation and deflation of the bladder, a flexible air line 50 communicates the interior of bladder with a conventional hand operated air pump 20. A conventional pressure relief valve 54 is disposed between the air line 50 and pump 20. Air line 50 preferably extends from the relief valve 54 through an opening in the neck support 28 and communicates with the bladder 18 through an opening formed in either the underside or, as shown in the drawings, through one end of the bladder.

In use, the traction and exercising device 10 rests on a horizontal surface such that the neck support 28 projects upwardly therefrom. The user lies on the device in a prone position such that the back of the neck rests on the deflated bladder 18 carried in the cradle 29 of the neck support 28. The chin and forehead restraining restraint straps 14–17 are respectively extended under the user's chin and about the user's forehead secured by the hook and loop fasteners 34 and 36, thereby affixing the traction and exercising device 10 to the user such that the neck and cervical spine extend over the neck support and bladder. In the preferred configuration of the invention, the outward extension of the neck support 28 is relatively slight so that when the bladder is in the deflated position with the forehead and chin restraints secured, very little or no force is exerted on the neck by the neck support. This is achieved by elevating the neck support 28 above the frame such that the neck cradle 29 formed therein is about 2.5–3 inches above the floor or other horizontal surface on which the device 10 is used. The bladder is sized such that upon full inflation, the apex of the curved upper surface of the bladder will extend about 5 inches above the floor.

Figure 8A:
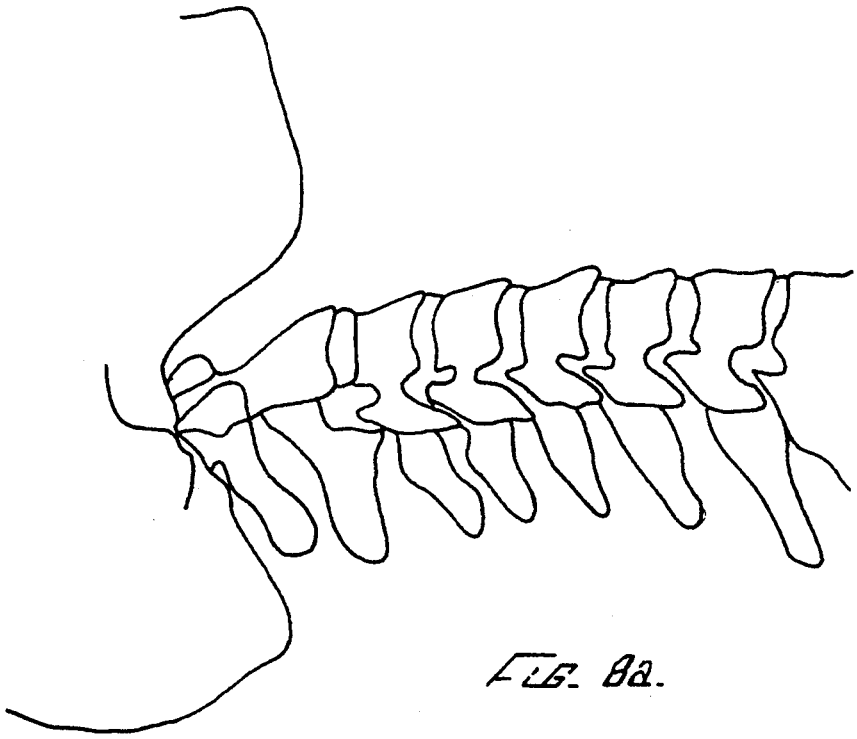
Figure 8B:
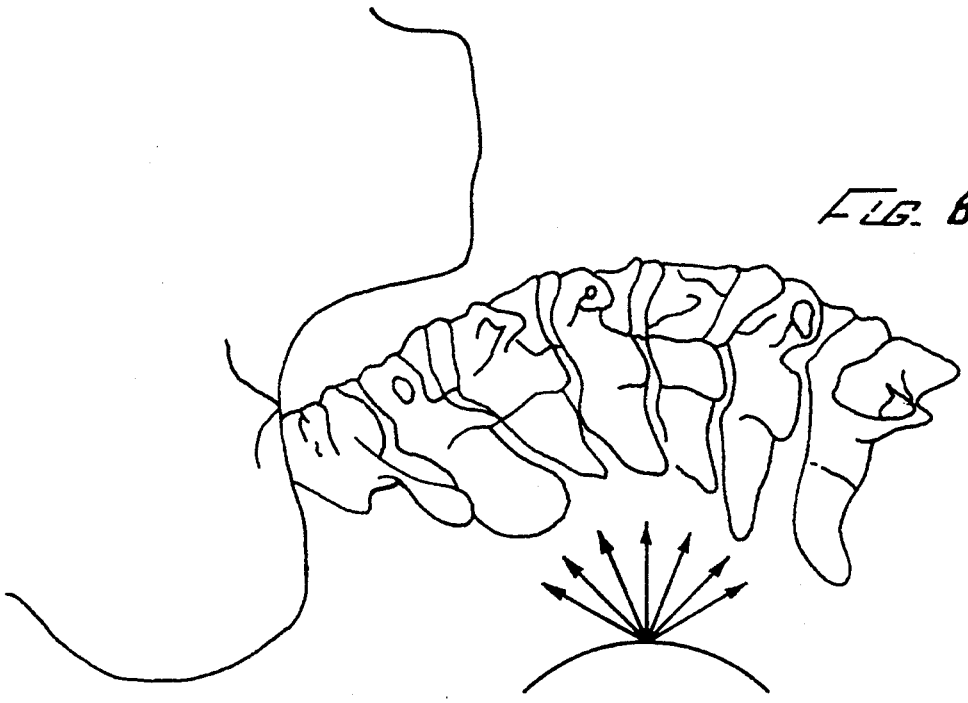

As the user slowly inflates the bladder 18 by means of air pump 50, the bladder expands upwardly and, to a lesser extent, transversely, thereby forcing the cervical spine forwardly creating a spinal apex while concurrently stretching the spine angularly along both sides of the formed spinal apex. The user then continues to inflate the bladder until his or her individual tolerance level is reached. The bladder is then deflated by use of the one way valve 52. The process is repeated several times, slowly increasing the spinal arc as the level of tolerance increases. In addition, the bladder can be held in an inflated state at or slightly below the level of tolerance for varying periods of time up to ten to twenty minutes. Through such repetition, the cervical spine and surrounding tissue receive a workout promoting cellular exchange in and around the intervertebral disc and a forward curve is reinstated into the cervical spine. FIGS. 8*a* and 8*b* illustrate the effect of the traction and exercise device 10 of the present invention on the cervical spine.

By way of example, a frame 12 of a traction and exercise device 10 made in accordance with the present invention defines a spacing of about nine inches between the side members 22 and 24 with each side member being of a tubular configuration 1.5 inches in diameter, about 11–12 inches in length, and being bowed slightly at 56 (see FIG. 3) proximate the extended ends 22' and 24' thereof to elevate the underside of the frame side members 22 and 24 disposed beneath the lateral ends of the neck support 28 about 0.5–0.75 inches above the floor. Such a configuration causes the extended ends 22' and 24' of the frame to bear against the floor during use and reduce the tendency of the frame to twist about its transverse axis. The arcuate frame spanning member 26 extends the overall length of the frame to about 15–17 inches. The cradle 29 in neck support 28 tapers from an elevation of about 3 inches above the floor proximate side members 22 and 24 to a central elevation of about 2.5 inches. The bladder 18 is constructed of an expandable material such as neoprene rubber, defines a length of about 9.25 inches, a height of about 3–4 inches in an uninflated state, depending on the configuration of the bladder and a transverse width of about 3 inches. The semi-ellipsoidal upper portion of the bladder, when inflated, defines a transverse arc of about 4 inches in length about the center of the bladder. It is to be understood that these dimensions are by way of example only and could be varied, as could the configuration of the frame and bladder without departing from the spirit and scope of the invention. Insofar as these changes and modifications are within the purview of the appended claims, they are to be considered as part of the present invention.

I claim:

1. A cervical traction and exercise device adapted to be positioned against a rigid support surface and secured about the user's head and neck for imparting a forward curve to the cervical spine and manipulating the spine and intervertebral discs to promote fluid transfer to the discs, said device comprising:

a support frame defining lateral support portions adapted to be disposed on opposite sides of the user's head and neck, said portions defining contact surfaces disposed in a common plane for abutting the rigid support surface;

A transverse neck support carried by said lateral support portions of said frame and extending thereacross outwardly spaced from said contact surfaces in a first direction normal to said plane;

An inflatable elongated bladder carried by said neck support and having an upper portion and a lower portion and defining a central longitudinal axis extending parallel to said plane and normal to said lateral support portions of said frame, said bladder being expandable in said first direction outwardly from said neck support and in a second direction substantially normal to said first direction and upon inflation, said upper portion of said bladder having a convex cross section taken along said longitudinal axis and extending outwardly from the transverse neck support;

means for securing said device to the user's head such that said upper portion of said bladder is disposed adjacent the back of the user's neck and transverses the cervical spine such that said first direction of expansion is toward and substantially normal to the cervical spine; and means for selectively inflating and deflating said bladder whereby upon said bladder expanding in said first direction, said upper portion of said bladder bears outwardly against the back of the user's neck and forces the cervical spine to curve forwardly and upon expanding in said second direction, applies an angular traction to the cervical spine and, upon repeated inflation and deflation of said bladder, a forward curve is imparted to the cervical spine and fluid transfer to the intervertebral discs is actively induced.

2. The device of claim 1 wherein said bladder is expandable in said first direction a greater distance than said bladder is expandable in said second direction.

3. The device of claim 1 wherein said lower portion of said bladder is disposed adjacent said neck support and defines a depending central portion for causing said bladder to expand outwardly from said neck support in said first direction a distance greater than the expansion of said bladder in said second direction, said upper portion of said bladder being substantially semi-ellipsoidal in configuration upon inflation.

4. A cervical traction and exercise device adapted to be secured about the head and neck for imparting a forward curve to the cervical spine and manipulating the spine and intervertebral discs to promote fluid transfer to the discs, said device comprising:

a support frame;

a transverse neck support carried by said frame and projecting upwardly therefrom;

a neck cradle defined by said transverse neck support;

an inflatable bladder carried by said neck support within said cradle, said bladder defining an upper portion and a lower portion, said lower portion being disposed within said cradle and defining a centrally disposed depending portion, and a pair of undercut portions adjacent said depending portions, said depending portion being disposed in said cradle and, upon inflation of said bladder, said depending and undercut portions of said bladder cause said bladder to expand outwardly from said neck support a distance greater than the expansion of said bladder in a transverse direction normal thereto and said upper portion of said bladder defines a substantially semi-ellipsoidal configuration;

means for securing said bladder within said cradle;

means carried by said frame for securing said device to the user's head such that said bladder is disposed adjacent the back of the user's neck and transverses the cervical spine such that said first direction of expansion is toward and substantially normal to the cervical spine; and means for selectively inflating and deflating said bladder whereby upon said bladder expanding in said first direction, said bladder bears outwardly against the back of the user's neck and forces the cervical spine to curve forwardly and upon expanding in said second direction, applies an angular traction to the cervical spine and, upon repeated inflation and deflation of said bladder, a forward curve is imparted to the cervical spine and fluid transfer to the intervertebral discs is actively induced.

5. The device of claim 1 wherein the upper portion of said bladder is substantially semi-ellipsoidal in configuration upon inflation.

* * * * *